United States Patent [19]

Tonnessen

[11] 4,011,964

[45] Mar. 15, 1977

[54] EQUATORIAL PROFILE FOR LARGE SPHERICAL TANKS

[75] Inventor: Arne Tonnessen, Moss, Norway

[73] Assignee: Moss Rosenberg Verft A/S, Norway

[22] Filed: Oct. 16, 1975

[21] Appl. No.: 623,029

[30] Foreign Application Priority Data

Apr. 24, 1975 Norway ..... 751471

[52] U.S. Cl. ..... 220/69; 114/74 A; 220/9 LG; 220/15

[51] Int. Cl.[2] ..... B65D 87/08; B65D 87/32; F17C 13/08

[58] Field of Search ..... 220/9 LG, 15, 18, 69; 114/74 A

[56] References Cited

UNITED STATES PATENTS

| | | | |
|---|---|---|---|
| 2,962,182 | 11/1960 | Rossheim | 220/69 X |
| 3,680,323 | 8/1972 | Bognaes et al. | 220/15 X |
| 3,859,805 | 1/1975 | Johnson et al. | 114/74 A X |

*Primary Examiner*—William Price
*Assistant Examiner*—Stephen Marcus
*Attorney, Agent, or Firm*—Burns, Doane, Swecker & Mathis

[57] ABSTRACT

A spherical tank has at the equatorial plane a projection for cooperation with a supporting skirt, the projection and adjoining components forming a groove with a rounded bottom, the groove bottom area having a cross-section with neutral axes deflected toward each other.

4 Claims, 7 Drawing Figures

FIG. 1
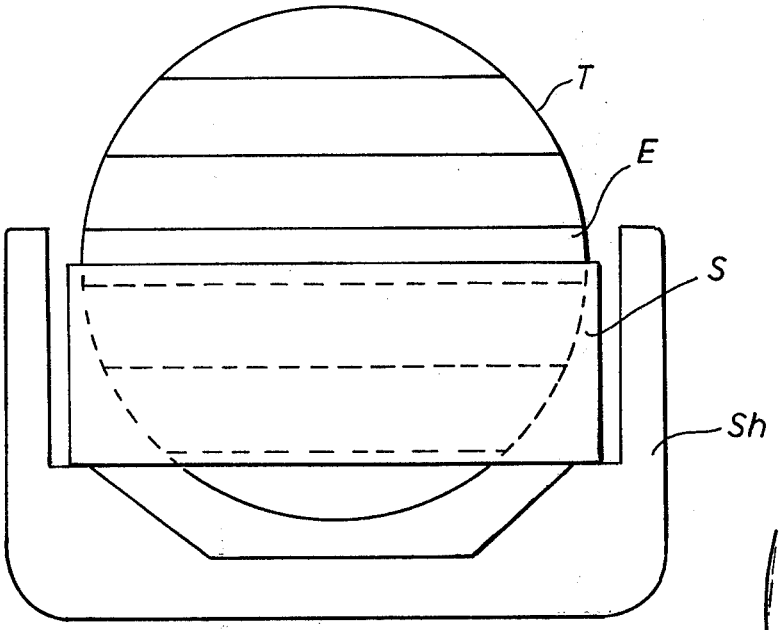
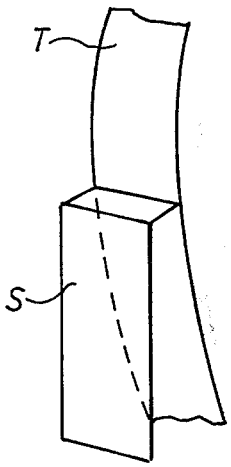
FIG. 2
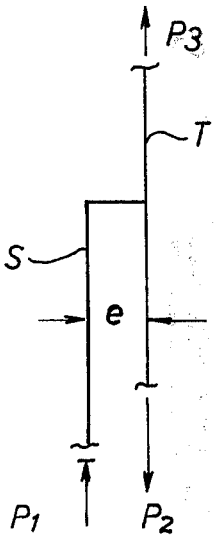
FIG. 3
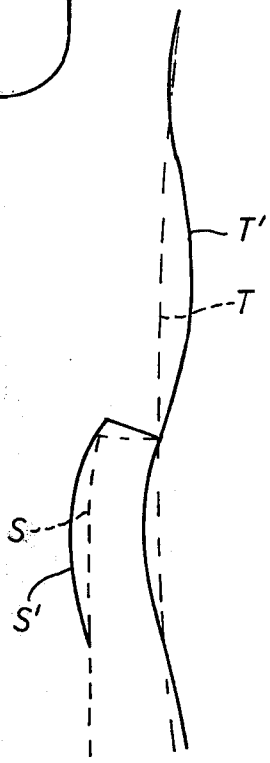
FIG. 4

EQUATORIAL PROFILE FOR LARGE SPHERICAL TANKS

The invention relates to an equatorial profile for large spherical tanks, said equatorial profile constituting a part of the spherical tanks shell and having an exterior, encircling projection intended for cooperation with the spherical tank's supporting device, preferably a skirt, the projection and the rest of the equatorial profile forming between them a groove with rounded groove bottom.

Equatorial profiles of this type are used today in large spherical tanks on board ships. The spherical tanks are mounted on the ship by means of a vertical skirt which extends from the bottom of the ship and is welded together with the projection of the equatorial profile. The equatorial profiles used today have proved to be fully satisfactory for large spherical tanks, with a diameter of up to 30 m and more, and will with corresponding dimensioning also be able to be used for spherical tanks with a diameter of 40 m or more. The most current material for large spherical tanks of this type is aluminium. The equatorial profile which is an essential element in the spherical tank, must be dimensioned accordingly, and it is also necessary with relatively thick plates over and under the equatorial profile to give sufficient bending rigidity in the construction. In practice an upper limit is encountered, set by the supplier of materials, with respect to the thickness of the equatorial profile. This, combined with the fact that the rigidity of the material decreases rapidly in thickness over 200 mm makes it desirable to be able to reduce the total thickness of the equatorial ring.

The forces and factors which prevail at the equator in large spherical tanks are shown in the drawings 1 to 4.

FIG. 1 shows very roughly a spherical tank T mounted at the equator on a cylindrical skirt S. The skirt S forms the spherical tank's T supporting device and goes down to the bottom structure in the ship SH. At the tank's equator is arranged a so-called equatorial profile E. This constitutes a part of the spherical tank's shell and has a projection which interacts with the skirt S.

FIG. 2 shows, in stylized form, a cross-section of the spherical tank at the equator. When the spherical tank is filled with a liquid the equator zone is chiefly stressed by forces shown in FIG. 3, where $P_1 = P_2$ minus $P_3$. The equatorial zone will be stressed by an element $M = P_1 \times e$ in which $e$ is the eccentricity between the skirt and tank. The element leads to a deformation as sketched in FIG. 4.

FIG. 5 shows an embodiment of the equatorial profile in cross-section which has been used up to now. The stresses in points A and B in the groove bottom are the deciding factors of the dimensions. Over and under the equatorial profile, relatively thick plates will, moreover, be necessary to give the construction sufficiently bending rigidity.

According to the invention the aim is to construct the equatorial profile in such a way that the bending stress in point B is reduced and also that the stress concentration in points A and B is reduced. Such reductions will make possible considerable reduction in the total thickness $t$ of the equatorial profile. Such a reduction of the total thickness is extremely essential as the tensile strength of the material diminishes rapidly in thicknesses over 200 mm (aluminium). A reduction of the total thickness $t$ makes it technically possible to increase the tank size considerably. It will also be possible thereby to considerably reduce the thickness of plates over and under the equatorial profile, because there will be a reduced need for rigidity in the construction in this area.

According to the invention the equatorial profile is designed in the cross-section with neutral axes deflected toward each other. The forces $P_1$ and $P_2$ (FIG. 3) will in such a construction entail local bending which will give respectively tensile stress at point A and compressive stress at point B (FIG. 5). These local stresses will counteract stresses caused by the forces and deformations shown in FIGS. 3 and 4.

In practice, the purpose of the invention is achieved preferably by the equatorial profile cross-section being narrowed in from both sides in the area at the groove bottom.

The invention will be described more closely with regard to the aforementioned FIGS. 1 – 5, and with particular regard to the following mention of a practical embodiment example as shown in FIGS. 6 and 7.

Figure 7:
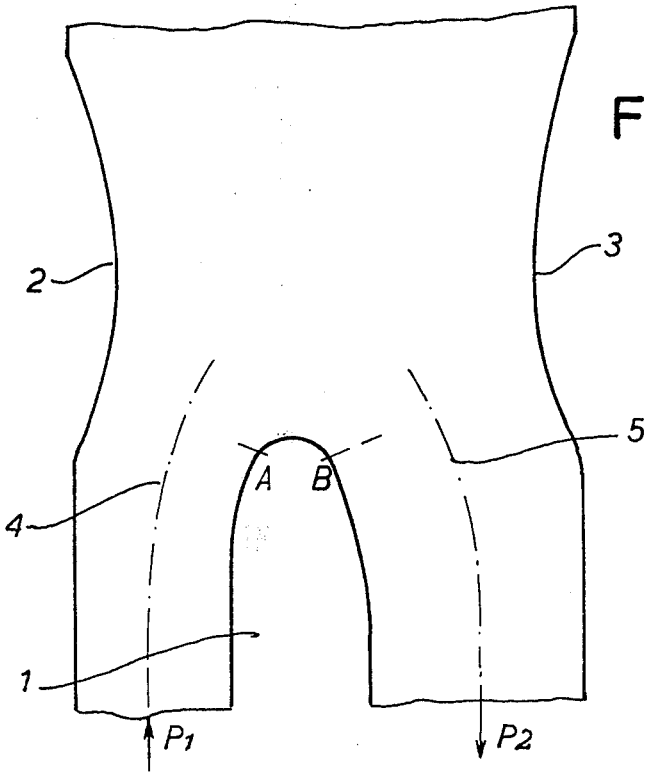
FIG. 7 shows an enlarged section of the area at the groove bottom in the profile in FIG. 6.

In the area at the bottom of the groove 1 in the equatorial profile, i.e., in the area at the previously mentioned points A and B, the equatorial profile is provided with a narrowing form by a hollow 2 on the outside of the profile and a hollow 3 on the inside of the profile, i.e. inside the spherical tank. These hollows, which cause the desired narrowing of the profile, as shown more closely in FIG. 7 deflect neutral axes 4 and 5.

The forces $P_1$ and $P_2$ will as a result of the neutral axes' deflections bring about local curvatures which cause respectively tensile stress at point A and compression stress at point B. These local stresses will counteract the stresses caused by the forces and deformations which are shown in FIGS. 3 and 4.

Figure 5:
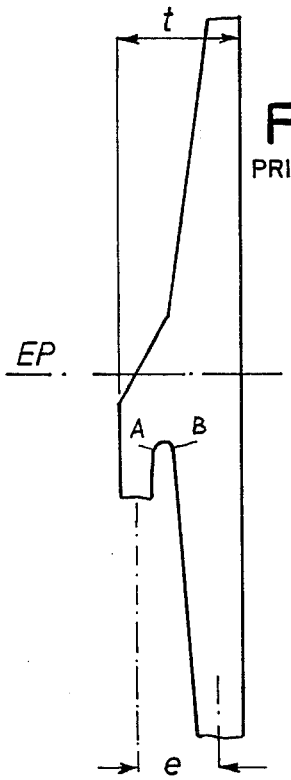
FIG. 5 PRIOR ART
Figure 6:
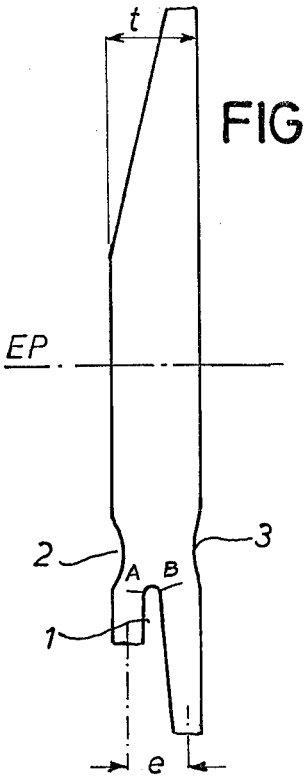
FIG. 6 shows a typical embodiment of an equatorial profile according to the invention, shown in cross-section.

At the same time, the equatorial profile is constructed in such a way that its heavily loaded area (points A and B) are spaced from the centre of the plate where the tensile strength is low. In FIGS. 5 and 6, for the sake of comparison, the equatorial planes are drawn in and designated by EP.

From FIGS. 5 and 6 one can see that the total thickness $t$ can be reduced considerably in the new construction. Such a reduction of the total thickness makes, as already mentioned, an increase in tank size to a considerable degree technically possible. Moreover, as also mentioned, the thickness of the plates over and under the equatorial profile can be considerably reduced. The heavily stressed area (A,B) is spaced from the centre of the plate where the tensile strength is low.

The new equatorial profile offers therefore great advantages. In addition the new equatorial profile requires less machining and welding.

The invention has been developed taking particularly into consideration the practical difficulties one encounters in using aluminum as material in the spherical tank and the equatorial profile. The invention is however, not limited to use only in connection with aluminium, inasmuch as it can also be utilized in connection with other materials.

Having described my invention, I claim:

1. In an equatorial profile operable to constitute a part of the shell of a large spherical tank which part of the shell presents an exterior encircling projection cooperable with supporting means for the spherical tank, and wherein the projection and remainder of the equitorial profile are arranged to define therebetween a groove with a rounded bottom, the improvement comprising means adjacent the area of said groove bottom for deflecting the neutral axis of said projection toward the neutral axis of the remainder of the equatorial profile on the other side of the groove, and means adjacent the area of said groove bottom for deflecting the neutral axis of said remainder of the profile on the other side of the groove toward the neutral axis of said projection.

2. The improvement according to claim 1 wherein said means for deflecting the neutral axis of said projection is provided by a narrowing hollow in the profile on the side of the projection and extending toward the rounded bottom groove, and wherein said means for deflecting the neutral axis of said remainder of the profile is provided by a narrowing hollow in the profile on said remainder thereof and extending toward the rounded bottom.

3. In an equatorial profile operable to constitute a part of the shell of a large spherical tank which part of the shell presents a main body portion and an exterior encircling projection cooperable with a supporting skirt for the spherical tank, said main body portion and said exterior encircling projection of said profile defining therebetween a groove with a rounded bottom, the improvement wherein said equatorial profile is provided with narrowing hollows adajacent said rounded bottom of the groove on both sides of the profile thereby to deflect toward one another the neutral axis of said projection and the neutral axis of said main body portion, which defines the groove therewith.

4. A large spherical tank assembly comprising:

a cylindrical supporting skirt, a spherical tank including an equatorial profile constituting a part of the shell of the tank, said equitorial profile presenting an encircling projection cooperable with said supporting skirt, said encircling projection and a portion of said profile separated therefrom by a groove with a rounded bottom, each presenting neutral axes and each being depressed adjacent said groove so as to mutually deflect both said neutral axes toward each other.

* * * * *